US011384418B2

(12) United States Patent
Sarban et al.

(10) Patent No.: US 11,384,418 B2
(45) Date of Patent: Jul. 12, 2022

(54) METHOD OF MANUFACTURING AN AL—SI—MG ALLOY ROLLED SHEET PRODUCT WITH EXCELLENT FORMABILITY

(71) Applicant: ALERIS ALUMINUM DUFFEL BVBA, Duffel (BE)

(72) Inventors: Ali Asghar Sarban, Turnhout (BE); Peter De Smet, Sint-Martens-Latem (BE)

(73) Assignee: ALERIS ALUMINUM DUFFEL BVBA, Duffel (BE)

( * ) Notice: Subject to any disclaimer, the term of this patent is extended or adjusted under 35 U.S.C. 154(b) by 428 days.

(21) Appl. No.: 16/611,662

(22) PCT Filed: May 9, 2018

(86) PCT No.: PCT/EP2018/062097

§ 371 (c)(1),
(2) Date: Nov. 8, 2019

(87) PCT Pub. No.: WO2018/206696

PCT Pub. Date: Nov. 15, 2018

(65) Prior Publication Data

US 2020/0224299 A1 Jul. 16, 2020

(30) Foreign Application Priority Data

May 11, 2017 (EP) ..... 17170580
Dec. 4, 2017 (EP) ..... 17205147

(51) Int. Cl.

| | |
|---|---|
| ***C22F 1/043*** | (2006.01) |
| ***C22F 1/02*** | (2006.01) |
| ***C22C 21/02*** | (2006.01) |
| ***C22F 1/00*** | (2006.01) |

(52) U.S. Cl.
CPC ..... *C22F 1/043* (2013.01); *C22C 21/02* (2013.01); *C22F 1/002* (2013.01)

(58) Field of Classification Search
CPC ..... C22F 1/043; C22F 21/02; C22F 1/002; C22F 21/08; C22F 1/05
See application file for complete search history.

(56) References Cited

U.S. PATENT DOCUMENTS

| | | | |
|---|---|---|---|
| 4,174,232 | A | 11/1979 | Lenz et al. |
| 2016/0002761 | A1 | 1/2016 | De Smet |

FOREIGN PATENT DOCUMENTS

| | | | |
|---|---|---|---|
| CN | 103014446 | A | 4/2013 |
| CN | 104641012 | A | 5/2015 |
| CN | 105026588 | A | 11/2015 |
| CN | 106521253 | A | 3/2017 |
| EP | 0679199 | A1 | 11/1995 |
| WO | 9514113 | A1 | 5/1995 |
| WO | 9814626 | A1 | 4/1998 |
| WO | 2014135367 | A1 | 9/2014 |

OTHER PUBLICATIONS

International Search Report and Written Opinion dated Jul. 12, 2018 for PCT/EP2018/062097 to Aleris Aluminum Duffel BVBA filed May 9, 2018.

*Primary Examiner* — Anthony M Liang
*Assistant Examiner* — Danny N Kang
(74) *Attorney, Agent, or Firm* — Vorys, Sater, Seymour and Pease LLP

(57) ABSTRACT

Method of manufacturing aluminium alloy rolled sheet product with excellent formability and good paint bake hardenability, including: casting Al—Si—Mg aluminium alloy ingot including, in wt. %: Si 1.0% to 1.50%, Mg 0.10% to 0.40%; heating the ingot to above 550° C.; maintaining the ingot above 550° C. for at least about 4 hours; cooling the ingot to 460° C. to 520° C. Maintaining the ingot at 460° C. to 520° C. for less than 6 hours. Hot-rolling the ingot in one or more rolling steps to intermediate gauge of 15 to 40 mm. The hot-mill exit temperature is 370° C. to 480° C. Further hot-rolling from intermediate gauge in one or more rolling steps to final hot rolling gauge. The hot-mill exit temperature is 310° C. to 400° C. Cooling the hot-rolled material at hot rolling final gauge from hot-mill exit temperature to ambient temperature. Cold rolling the hot-rolled product to a cold-rolled product of final gauge.

25 Claims, No Drawings

METHOD OF MANUFACTURING AN AL—SI—MG ALLOY ROLLED SHEET PRODUCT WITH EXCELLENT FORMABILITY

CROSS-REFERENCE TO RELATED APPLICATIONS

This is a § 371 National Stage Application of International Application No. PCT/EP2018/062097 filed on May 9, 2018, claiming the priority of European Patent Application No. 17205147.6 filed on Dec. 4, 2017 and European Patent Application No. 17170580.9 filed on May 11, 2017.

FIELD OF THE INVENTION

The invention relates to a method of manufacturing an Al—Si—Mg aluminium alloy rolled sheet product with excellent formability. The sheet product can be applied ideally as automotive body sheet.

BACKGROUND TO THE INVENTION

Generally, outer body panels of a vehicle require excellent physical properties in formability, hemmability, dent-resistance, corrosion resistance and surface quality. The conventional AA5000-series alloy sheets have not been favoured for that application because they have low mechanical strength even after press forming and may also exhibit poor surface quality. Therefore, 6000-series sheet alloys have been increasingly used. The 6000-series alloys provide excellent bake hardenability after paint baking and high mechanical strength as a result, thus making it possible to manufacture more thin-gauged and more light-weight sheets in combination with a class-A surface finish.

U.S. Pat. No. 4,174,232 discloses a process for fabricating age-hardenable aluminium alloys of the Al—Mg—Si type by strip casting and applying a specific annealing process. The disclosed aluminium is also embraced by the registered AA6016 alloy. The chemical composition of the registered AA6016 is, in wt. %:

| | |
|---|---|
| Si | 1.0 to 1.5, |
| Mg | 0.20 to 0.6, |
| Fe | up to 0.50, |
| Cu | up to 0.25, |
| Mn | up to 0.20, |
| Cr | up to 0.10, |
| Zn | up to 0.20, |
| Ti | up to 0.15, |

impurities each <0.05, total <0.15, balance aluminium.

The AA6016 rolled sheet products in the higher strength range when used for automotive parts are known to have limited formability and limited hemming performance.

There is a need for selection of aluminium alloy rolled sheet products and methods for producing vehicle parts or members providing good strength and levels of formability into vehicle parts.

DESCRIPTION OF THE INVENTION

As will be appreciated herein below, except as otherwise indicated, aluminium alloy designations and temper designations refer to the Aluminium Association designations in Aluminium Standards and Data and the Registration Records, as published by the Aluminium Association in 2016 and are well known to the person skilled in the art.

For any description of alloy compositions or preferred alloy compositions, all references to percentages are by weight percent unless otherwise indicated. The term "up to" and "up to about", as employed herein, explicitly includes, but is not limited to, the possibility of zero weight-percent of the particular alloying component to which it refers. For example, up to 0.20% Zn may include an alloy having no Zn, and thus there may be an absence of such element.

It is an object of the invention to provide a method of manufacturing an Al—Si—Mg alloy or AA6000-series alloy rolled sheet product having improved formability.

It is another object of the invention to provide a method, or at least an alternative method, of manufacturing an Al—Si—Mg alloy or AA6000-series alloy rolled sheet product of defined composition and having improved formability wherein the sheet product in T4 condition has a planar anisotropy of Lankford value delta-r in a range of 0.3 or more.

These and other objects and further advantages are met or exceeded by the present invention and providing a method of manufacturing an aluminium alloy rolled sheet product, in particular an automotive sheet product, with excellent formability and good paint bake hardenability, the method comprising:

(a) casting an ingot of an Al—Si—Mg aluminium alloy having a composition consisting of, in wt. %: Si 1.0% to 1.50%, Mg 0.10% to 0.40%, Fe 0.08% to 0.30%, Cu up to 0.15%, Mn 0.01% to 0.15%, Cr up to 0.10%, Zr up to 0.03%, V up to 0.03%, Zn up to 0.20%, Ti up to 0.10%, impurities each <0.05%, total <0.15%, balance aluminium;

(b) heating the ingot to a temperature of above 550° C.; maintaining the ingot at a temperature of above 550° C. for at least about 4 hours; cooling the ingot to a temperature in a range of 460° C. to 520° C.; and maintaining the ingot at a temperature in a range of 460° C. to 520° C. for less than 6 hours;

(c) hot-rolling of the ingot in one or more rolling steps to an intermediate gauge in a range of 15 mm to 40 mm, preferably 15 mm to 30 mm, and wherein the hot-mill exit temperature is in a range of 370° C. to 480° C.;

(d) further hot-rolling from intermediate gauge in one or more rolling steps to a final hot rolling gauge in a range of 3 mm to 15 mm, and wherein the hot-mill exit temperature is in a range of 310° C. to 400° C.;

(e) cooling of the hot-rolled material at hot rolling final gauge from hot-mill exit temperature to below 200° C., and preferably to ambient temperature.

(f) cold rolling, typically at a temperature between 15° C. and 100° C., and more preferably at ambient temperature of the hot-rolled product to a cold-rolled product of final gauge of 0.8 to 4.0 mm, preferably of 0.8 to 3.0 mm, and more preferably of 0.8 to 2.5 mm.

Optionally during the cold rolling operation an intermediate annealing (continuous or batch) can be applied to the cold-rolled product at an intermediate gauge at a temperature in the range of 360° C. to 450° C., and preferably at a temperature not higher than 430° C. This will not adversely affect the final mechanical properties of the sheet product and will enhance the surface quality.

Next the cold rolled sheet product at final gauge is processed by (g) solution heat treating comprising heating the cold rolled product to a temperature and for a time such that substantial amounts of the $Mg_2Si$ and Si are dissolved into solid solution, typically at a temperature of 500° C. or more, and preferably at a temperature in a range of 530° C.

to 570° C., for up to about 2 minutes, preferably for up to about 1 minute, (e.g. up to about 50 seconds), and (h) after the solution heat treating, quenching of the rolled sheet product, for example by means of water such as (cold) water quenching or (cold) water spray quenching.

In accordance with the invention it has been found that the alloy composition in combination with the homogenisation practice and the subsequent hot rolling practice provides for an improved formability, and improved stretch formability in particular, of the aluminium sheet product while maintaining good hemmability and surface quality, good corrosion resistance and reaching sufficient strength in a three-dimensional formed part after being subjected to a paint bake cycle. The aluminium alloy sheet product when in a T4 temper has an anisotropy of Lankford value delta-r of 0.3 or more, and preferably in a range of 0.3 to 0.4. The aluminium alloy sheet product in T4 condition achieves a desirable strain hardening exponent n of more than 0.2, preferably of more than 0.3. The aluminium alloy sheet product in T4 condition achieves a uniform elongation Ag of more than 24%.

It is also an important finding of the invention that in the T4 condition the mechanical properties of the sheet product remain substantially stable for at least up to about 6 months, and even up to 12 months, which is a desirable property or sheet characteristic with regard to intermediate storage of the sheet product.

The mechanical properties including strain hardening exponent n, Lankford delta-r values and elongation are measured by tensile testing according to international standard ISO 6892-1 (second edition, July 2016). As known to the skilled person the Lankford anisotropy delta-r value is calculated from the average of at least three (e.g. 3 or 4) values of Lankford coefficient or r-value in three directions (rolling direction ($r_0$), transverse direction ($r_{90}$) and 45° to the rolling direction ($r_{45}$)) whereby $\Delta r=(r_0+r_{90}-2r_{45})/2$ and measured between a uniform elongation of 8% and 12%. The strain hardening exponent n is the average of at least three values measured between a uniform elongation of 4% and 6%.

The Al—Si—Mg alloy can be provided as an ingot or slab for fabrication into rolling feedstock using casting techniques regular in the art for cast products, e.g. DC-casting, EMC-casting, and preferably having an ingot thickness in a range of about 220 mm or more, e.g. 400 mm, 500 mm or 600 mm. In another embodiment thin gauge slabs resulting from continuous casting, e.g. belt casters or roll casters, also may be used, and having a thickness of up to about 40 mm. After casting the rolling feedstock, the thick as-cast ingot is commonly scalped to remove segregation zones near the cast surface of the ingot.

Next the ingot is homogenised by heating the ingot to a temperature of above 550° C., but at a temperature lower than the solidus temperature of the subject alloy; maintaining the ingot at this temperature for at least about 4 hours, and preferably for at least about 10 hours. In a preferred embodiment the ingot is heated to a temperature of above 570° C. A preferred upper-limit for the homogenisation soaking time is about 40 hours, and more preferably for not more than about 24 hours. A too long soaking time may lead to an undesired coarsening of dispersoids adversely affecting the mechanical properties of the final sheet product. Next cooling of the ingot to a temperature in a range of 460° C. to 520° C.; and maintaining the ingot at a temperature in a range of 460° C. to 520° C. for less than 6 hours, and preferably less than 4 hours. A too long duration will cause extensive precipitation of particles that will lead to particle stimulated nucleation with a more random texture and a too low anisotropy of Lankford value delta-r as result. In an embodiment the ingot is cooled to a temperature of more than 480° C. In an embodiment the ingot is cooled to a temperature of less than 510° C.

The formability is further increased by adapting the hot rolling practice wherein in a first hot rolling operation the heated feedstock is subjected to breakdown hot rolling in one or more passes using reversing or non-reversing mill stands that serve to reduce the thickness of the rolling feedstock or ingot to an intermediate gauge range of 15 mm to 40 mm, and preferably of 15 to 35 mm. The breakdown rolling starts preferably at a temperature in the range of about 460° C. to 510° C., and preferably of 470° C. to 500° C. The hot-mill process temperature should be controlled such that after the last rolling pass the hot-mill exit temperature of the feedstock is in a range of about 370° C. to 480° C. A more preferred lower-limit is about 380° C. A more preferred upper-limit is about 450° C., and more preferably 430° C.

Next after the breakdown hot rolling, the feedstock is supplied to a mill for hot finish rolling in one or more passes to a final gauge in the range of 3 mm to 15 mm, for example 7 mm or 10 mm. The hot finishing rolling operation can be done for example using a reverse mill or a tandem mill. Overall, the thickness of the rolling feedstock or ingot is typically reduced (and thereby taking processing step (c) and (d) together) by at least about 65%, and more typically in the range of 80% to 97%. The average temperature of the hot rolled feedstock when the feedstock is inputted into process (d) is maintained preferably at a temperature of 370° C. to 480° C. A more preferred lower-limit is about 400° C. A more preferred upper-limit is about 450° C.

Control of the finish hot-mill exit temperature of the rolling feedstock is important to arrive at the desired balance of metallurgical properties, and preferably the hot-mill temperature should be controlled such that after the last rolling pass the hot-mill exit temperature of the feedstock is in a range of about 310° C. to 400° C. to control the $Mg_2Si$ and Si particles growth. A preferred lower-limit is about 320° C., and more preferably about 340° C. A preferred upper-limit is about 380° C., and more preferably about 360° C. A too low exit-temperature of the hot rolled feedstock will inhibit recrystallization. A too high exit temperature can cause grain coarsening and precipitation coarsening that will promote recrystallization by PSN at the expense of Cube recrystallization resulting in a more random texture and reduced anisotropy of Lankford value delta-r.

Following the last hot-rolling step the hot-rolled feedstock at final gauge is cooled to below 200° C., more typically to below 100° C., and preferably to ambient temperature. In a preferred embodiment the cooling of the hot-rolled feedstock at final gauge from hot-mill exit temperature during process step (e) is by immediately coiling of the hot-rolled feedstock and allowing it to cool in an ambient environment to ambient temperature and stored.

In a next step the hot rolled material is being further down gauged by cold rolling applying in one or more rolling steps a total cold rolling degree of at least 45%, preferably of at least 60%.

Optionally during the cold rolling operation an intermediate annealing (continuous or batch) can be applied to the cold-rolled product at an intermediate gauge.

Following the optional intermediate annealing heat treatment the feedstock is cold rolled in one or more cold rolling steps to a final gauge in a range of 0.8 mm to 4.0 mm. A preferred upper-limit for the sheet thickness is 3.0 mm and more preferably 2.5 mm.

In an embodiment of the method the cold rolled aluminium sheet product at final gauge is solution heat treated at a temperature and for a time such that substantial amounts of $Mg_2Si$ and Si are dissolved into solid solution. The solution heat-treatment temperature is at least 500° C., and is preferably in a range of 530° C. to 570° C., and more preferably in the range of 540° C. to 565° C., and is more preferably just above the solvus temperature of the $Mg_2Si$ and Si phases, to further improve formability characteristics of the aluminium alloy sheet product. After the solution heat treating the sheet is quenched, e.g. by means of water such as cold water quenching or cold water spray quenching.

In an embodiment, following the solution heat treatment and quenching of the sheet product, the sheet product is subjected to artificially aged or pre-ageing and natural ageing for 72 hours or longer prior to forming into e.g. a three-dimensional shaped or formed automotive body member. The pre-ageing is preferably performed by holding the sheet material at a temperature of 160° C. to 230° C. for up to 10 minutes, e.g. 40 sec, 1 min. or 3 min., within seven days after ending of the solution heat treatment and quenching, and preferably in a continuous annealing line immediately following the solution heat treatment and quenching. The pre-ageing treatment provides for in time more stable mechanical properties of the sheet product before the forming of an automotive body member and a better hardening response after being subjected to a paint bake cycle.

In an embodiment, following the solution heat treatment and quenching of the sheet product, the sheet product is subjected to natural ageing for 72 hours to 6 months, optionally even longer, prior to forming into e.g. a three-dimensional shaped or formed automotive body member.

A formed automotive body member includes bumpers, doors, hoods, trunk lids, fenders, floors, wheels and other portions of an automotive or vehicle body. Due to its excellent deep drawing properties and stretch forming properties the alloy sheet product is also perfectly suited to produce also inner door panels, wheel arch inner panels, and side panels, spare wheel carrier panels and similar panels with a high deep drawing height. Forming operations into three-dimensional shapes includes deep-drawing, pressing, stamping and stretch forming.

Following the forming operation the formed part may be made part of an assembly of other metal components as regular in the art for manufacturing vehicle components, and subjected to a paint bake operation to cure any paint or lacquer layer applied. The paint bake operation or cycle comprises one or more sequential short heat treatment in the range of 140° C. to 210° C. for a period of 10 to less than 40 minutes, and typically of less than 30 minutes. A typical paint bake cycle would comprise a first heat treatment of 180° C.@20 minutes, cooling to ambient temperature, then 160° C.@20 minutes and cooling to ambient temperature. In dependence of the OEM such a paint bake cycle may comprise of 2 to 5 sequential steps and includes drying steps.

In accordance with the invention the alloy product is in the form of a sheet or sheet product, more preferably an automotive sheet product. The sheet product has a thickness in a range of 0.8 mm to 4.0 mm in thickness. A preferred upper-limit for the sheet thickness is 3.0 mm and more preferably 2.5 mm.

Effects and reasons for limitations of the alloying elements in the Al—Si—Mg alloy automotive sheet manufactured in accordance with the method of the present invention are described below.

The purposive addition of Mg and Si strengthens the aluminium alloy due to precipitation hardening of elemental Si and $Mg_2Si$ formed under the co-presence of Mg. In order to provide a sufficient strength level and elongation in the final sheet product according to the invention the Si content should be at least 1.0%, and preferably at least 1.10%, and more preferably at least 1.30%. The upper-limit for the Si content is 1.50%, and preferably 1.40%. The presence of Si in solid solution enhances also the formability.

Substantially for the same reason as for the Si content, the Mg content should be at least 0.10%, and preferably at least 0.15%, and more preferably at least 0.20%, to provide sufficient strength to the sheet product. The upper-limit for the Mg content is 0.40%, and a preferred upper-limit for the Mg content is 0.35%, and more preferably 0.30%. The Mg level in the sheet product should be kept relatively low such that the sheet product in a T6 condition reaches a yield strength of at least 150 MPa, and preferably of at least 160 MPa. The T6 condition is based of sheet material in T4 condition and subsequently subjected to a simulated paint bake cycle of 2% stretching and holding the material for 20 minutes at 185° C. Furthermore, it provides the condition for a stable natural ageing behaviour of the sheet product such that the mechanical properties of the sheet product remain substantially stable for at least up to about 6 months, which is a desirable property or sheet characteristic with regard to intermediate storage of the sheet product.

To increase the elongation and strain hardening rate for the purpose of improving formability and delaying plastic instability and fracture, in an embodiment the Si and Mg are present such that the ratio (in wt. %) of Si/Mg exceeds 4.0, and more preferably exceeds 4.5. In a preferred embodiment of the aluminium sheet the Si/Mg is 5.0 or more. A preferred upper-limit for the Si/Mg ratio is 6.0, and more preferably 5.8. In one embodiment the Si/Mg-ratio is 5.55.

It is important that the Fe content in the aluminium alloy sheet product should not exceed 0.25%, and preferably it should not exceed 0.20%, in order to obtain the improved formability. Too high Fe levels lead to the development of Fe-containing particles and dispersoids that promote Particle Stimulated Nucleation and contribute to a weak and random texture. A more preferred upper-limit for the Fe content is 0.18%. A lower Fe-content is favourable for the formability of the sheet product. A lower limit for the Fe-content is 0.08%, and preferably 0.12%, and more preferably 0.13%. A too low Fe content may lead to undesirable recrystallized grain coarsening, and it makes the aluminium alloy too expensive.

It is known in the art that the purposive addition of Cu may lead to increased strength. However, in the alloy sheet product according to this invention it may be present only up to 0.12%, in order to maintain a good corrosion performance. In a preferred embodiment Cu is purposively added in a range of at least 0.01%. A preferred upper-limit for the Cu is 0.10%, and more preferably 0.08%, and most preferably 0.06%.

Mn is added to the alloy sheet product for grain size control to improve the formability of the sheet product. In particular the elongation is improved due to the reduced fraction of constituent particles. The Mn level should be present in a range of 0.01% to 0.15%. A preferred lower-limit for the Mn content is about 0.03%. A more preferred upper-limit for the Mn content is about 0.10%, and more preferably 0.08%.

Cr can be present up to 0.10%. Cr is preferentially avoided in the sheet product as it may prevent full recrystallization of the sheet product. Preferably it is tolerated up to 0.04%, and is preferably less than 0.03%, and more preferably less than 0.02%.

Also each of vanadium (V) and zirconium (Zr) are preferentially avoided in the sheet product as they may prevent full recrystallization of the sheet product. Such elements are costly and/or form detrimental intermetallic particles in the aluminium alloy. Thus, the sheet product generally includes not greater than 0.03% V and not greater than 0.03% Zr. In a preferred embodiment the sheet product includes V only up to 0.02%. In a preferred embodiment the sheet product includes Zr only up to 0.02%.

Zn may optionally be included in the alloy, and in an amount up to about 0.20%. Zinc may be present in scrap, and its removal may be costly. In one embodiment, the alloy includes not greater than 0.10% Zn, and in a preferred embodiment the alloy includes not greater than 0.05% Zn.

Ti can be added to the sheet product amongst others for grain refiner purposes during casting of the alloy ingots. The addition of Ti should not exceed 0.10%, and preferably it should not exceed about 0.05%. A preferred lower limit for the Ti addition is about 0.008%, and can be added as a sole element or with either boron or carbon as known in the art serving as a casting aid, for grain size control.

Unavoidable impurities can be present up to 0.05% each, and a total of up to 0.15%, the balance is made with aluminium.

In a preferred embodiment unavoidable impurities can be present up to 0.03% each, and more preferably up to 0.02%, and a total of up to 0.10%, the balance is made with aluminium.

In another aspect of the invention there is provided an aluminium alloy sheet product at a gauge in a range of 0.8 mm to 4.0 mm and having a composition consisting of (in wt. %): Si 1.0% to 1.50%, Mg 0.10% to 0.40%, Fe 0.08% to 0.30%, Cu up to 0.15%, Mn 0.01% to 0.15%, Cr up to 0.10%, Zr up to 0.03%, V up to 0.03%, Zn up to 0.15%, Ti up to 0.10%, impurities each <0.05%, total <0.15%, balance aluminium, and with preferred narrower compositional ranges as herein described and claimed, and having in T4 condition a Lankford anisotropy value delta-r of 0.3 or more, and a strain hardening exponent n>0.3 and a uniform elongation Ag>24%.

The invention is also related to the use of the aluminium alloy sheet product according to this invention and of the aluminium alloy sheet product obtained by the method according to this invention in the form of a three-dimensional shaped or formed automotive panel, in particular an inner door panel, an outer door panel, or a side panel.

EXAMPLES

The invention will now be illustrated with reference to the following non-limiting examples, both according to the invention and comparative.

Sheet products of 1.0 mm final gauge have been produced on an industrial scale using various processing conditions. For each case, the resulting sheet products consisted of an aluminium alloy having the following composition, in wt. %: 1.35% Si, 0.25% Mg, 0.14% Fe, 0.07% Mn, 0.01% Cu, 0.02% Ti, 0.01% Cr, balance impurities and aluminium.

The rolling feedstock has been cast into rolling ingots having a thickness of 500 mm and scalped on either side. The key pre-heat and hot rolling processing parameters of the various sheet products are listed in Table 1, wherein sheet A is according to the invention and sheets B, C and D are comparative.

Following the hot rolling operation the products were cold rolled to intermediate gauge, inter-annealed, and cold rolled to final gauge of 1.0 mm, and solution heat treated at 560° C. in a continuous annealing furnace and then quenched.

The resulting mechanical properties are listed in Table 2 and have been measured according to international standard ISO 6892-1 (second edition, July 2016). The mechanical properties (average over 3 samples) Rp0.2, Rm, the elongation A80, the uniform elongation Ag, and the strain hardening exponent n in the T4 condition have been measured in the transverse direction 14 days following solution heat treatment and quench. The samples were also subjected to a simulated paint-bake cycle, which consisted of a 2% stretch and soaking at 185° C. for 20 min., resulting in a T6 condition. The tensile tests in T6 condition were done in the transverse direction and the increase in Rp0.2 between T6 and T4 is given as the paint-bake response (PBR).

TABLE 1

Pre-heat and hot rolling processing parameters applied.

| Processing step | Sheet A Invention | Sheet B | Sheet C Comparative | Sheet D |
|---|---|---|---|---|
| Preheat steps | 575° C. @ 18 hr + 510° C. @ 4 hr | 560° C. @ 16 hr | 575° C. @ 8 hr + 510° C. @ 4 hr | 575° C. @ 18 hr + 440° C. @ 3 hr |
| Breakdown start temp. | 485° C. | 545° C. | 485° C. | 425° C. |
| Breakdown finish temp. | 435° C. | 345° C. | 435° C. | 400° C. |
| Breakdown end gauge | 28 mm | 28 mm | 30 mm | 28 mm |
| Tandem rolling start temp. | 425° C. | 330° C. | 425° C. | 385° C. |
| Tandem rolling finish temp. | 355° C. | 285° C. | 275° C. | 265° C. |
| Tandem rolling end gauge | 8 mm | 8 mm | 8 mm | 8 mm |

TABLE 2

Mechanical properties of the final sheet product.

| Property | Sheet A | Sheet B | Sheet C | Sheet D |
|---|---|---|---|---|
| Rp0.2 - T4 (MPa) | 82.0 | 97.6 | 96.9 | 84.2 |
| Rm - T4 (MPa) | 185.8 | 191.5 | 201.8 | 182.8 |
| Rp0.2 - T6 (MPa) | 159.7 | 181.7 | 190.8 | 124.5 |
| Rm0.2- T6 (MPa) | 224.7 | 242.1 | 252.7 | 192.9 |
| PBR (MPa) | 77.7 | 84.1 | 93.9 | 40.3 |
| Δr | 0.38 | 0.25 | 0.19 | 0.25 |
| n90° | 0.32 | 0.28 | 0.31 | 0.31 |
| Ag (%) | 24.6 | 24.2 | 22.6 | 23.3 |
| A80 (%) | 27.4 | 26.8 | 25.4 | 26.9 |

From the results of Table 2 it can be seen that the aluminium alloy product (sheet A) processed in accordance with this invention requiring a careful control of the pre-heat temperatures and of the hot rolling practice provides a sheet product having in the T4 condition a desirable balance of strength, a good paint bake response, and more in particular a Lankford anisotropy value delta r of more than 0.3, a strain hardening exponent n of more than 0.3 and an uniform elongation Ag of more than 24%, all indicating a very good formability of the sheet product for forming into for example a formed automotive panel.

Whereas sheet B has been processed using a single-step pre-heat resulting in a very high breakdown hot rolling starting temperature, and the tandem rolling was done at relative low temperatures. This resulted in higher strength, both in T4 and T6, but also in a significantly lower Lankford anisotropy value delta r. Also the strain hardening exponent n was below 0.3.

Sheet product C has been processed very similar as sheet product A, except for a significant lower-exit temperature at the tandem rolling mill. This resulted in higher strength, both in T4 and T6, compared to sheet product A, but resulted also in a significantly lower Lankford anisotropy value delta r and a drop in the uniform elongation and thereby adversely affecting the formability characteristics of the sheet product.

Sheet product D has been processed using a too low second pre-heat temperature and a too low break-down hot rolling start temperature and a too low exit temperature at the tandem rolling mill. This resulted in very low strength in the T6 condition and consequently in a small paint-bake response. In addition it resulted in a significantly lower Lankford anisotropy value delta r and a drop in the uniform elongation and thereby adversely affecting the formability characteristics of the sheet product.

The invention is not limited to the embodiments described before, which may be varied widely within the scope of the invention as defined by the appending claims.

The invention claimed is:

1. A method of manufacturing an aluminium alloy rolled sheet product, with excellent formability and good paint bake hardenability, the method comprising:

(a) casting an ingot of an Al—Si—Mg aluminium alloy having a composition consisting of, in wt. %:

| | |
|---|---|
| Si | 1.0% to 1.50%, |
| Mg | 0.10% to 0.40%, |
| Fe | 0.08% to 0.30%, |
| Cu | up to 0.15%, |
| Mn | 0.01% to 0.15%, |
| Cr | up to 0.10%, |
| Zr | up to 0.03%, |
| V | up to 0.03%, |
| Zn | up to 0.20%, |
| Ti | up to 0.10%, |

each unavoidable impurity less than 0.05%, a total of unavoidable impurities less than 0.15%, and a balance aluminium;

(b) heating the ingot to a temperature of above 550° C.; maintaining the ingot at a temperature of above 550° C. for at least about 4 hours; cooling the ingot to a temperature in a range of 460° C. to 520° C.; and maintaining the ingot at a temperature in a range of 460° C. to 520° C. for less than 6 hours;

(c) hot-rolling of the ingot in one or more rolling steps to an intermediate gauge in a range of 15 mm to 40 mm, and wherein a hot-mill exit temperature is in a range of 370° C. to 480° C.;

(d) further hot-rolling from the intermediate gauge in one or more rolling steps to a hot rolling final gauge in a range of 3 mm to 15 mm, and wherein a hot-mill exit temperature is in a range of 310° C. to 400° C., thereby obtaining a hot-rolled material at hot rolling final gauge;

(e) cooling of the hot-rolled material at hot rolling final gauge from the hot-mill exit temperature to below 200° C., thereby obtaining a hot-rolled product;

(f) cold rolling the hot-rolled product, thereby obtaining a cold-rolled product having a final gauge between 0.8 mm to 4.0 mm.

2. The method according to claim 1, wherein the method further comprises the steps of:

(g) solution heat treating the aluminum alloy rolled sheet product at a temperature of 500° C. or more; and (h) after the solution heat treating, quenching of the aluminum alloy rolled sheet product, thereby obtaining a solution heat-treated and quenched rolled product.

3. The method according to claim 2, wherein the method further comprises (k) artificially ageing the aluminum alloy rolled sheet product.

4. The method according to claim 2, wherein the method further comprises the steps of (i) natural ageing for 72 hours to 6 months of the solution heat-treated and quenched rolled product, thereby obtaining a natural aged rolled product, (j) forming of the natural aged rolled product into a three-dimensional shaped object, and (k) subjecting the three-dimensional shaped object to a paint bake cycle.

5. The method according to claim 1, wherein in process step (c) the hot-mill exit temperature is in a range of 380° C. to 450° C.

6. The method according to claim 1, wherein in process step (c) a hot-mill entry temperature is in a range of 460° C. to 510° C.

7. The method according to claim 1, wherein in process step (d) the hot-mill exit temperature is in a range of 320° C. to 380° C.

8. The method according to claim 1, wherein in process step (d) a hot-mill entry temperature is in a range of 370° C. to 480° C.

9. The method according to claim 1, wherein the Si-content in the Al—Si—Mg aluminium alloy is 1.10% to 1.5%.

10. The method according to claim 1, wherein the Mg-content in the Al—Si—Mg aluminium alloy is 0.15% to 0.40%.

11. The method according to claim 1, wherein the Si- and Mg-content in the Al—Si—Mg aluminium alloy are present such that Si/Mg weight ratio is more than 4.0.

12. The method according to claim 1, wherein the Fe-content in the Al—Si—Mg aluminium alloy is 0.08% to 0.25%.

13. The method according to claim 1, wherein the Cu-content in the Al—Si-—Mg aluminium alloy is up to 0.12%.

14. The method according to claim 1, wherein the Cr-content in the Al—Si—Mg aluminium alloy is up to 0.04%.

15. The method according to claim 1, wherein the aluminium alloy rolled sheet product forms an inner door panel or an outer door panel of a car.

16. The method according to claim 1, wherein the aluminium alloy rolled sheet product forms a side panel of a car.

17. The method of claim 1, wherein the aluminium alloy rolled sheet product is an automotive sheet product, wherein the intermediate gauge range is 15 mm to 30 mm;

wherein the cooling of the hot-rolled material at hot rolling final gauge is from the hot-mill exit temperature to ambient temperature;

wherein the cold rolling of the hot-rolled product forms a cold-rolled product having a final gauge between 0.8 mm to 3.0 mm.

18. The method according to claim 17, wherein the cold rolling of the hot-rolled product forms a cold-rolled product having a final gauge between 0.8 to 2.5 mm.

19. The method according to claim 1, wherein in process step (c) the hot-mill exit temperature is in a range of 380° C. to 430° C.

20. The method according to claim 1, wherein the Si-content in the Al—Si—Mg aluminium alloy is 1.0% to 1.40%.

21. The method according to claim 1, wherein the Mg-content in the Al—Si—Mg aluminium alloy is 0.10% to 0.35%.

22. The method according to claim 1, wherein the Si- and Mg-content in the Al—Si—Mg aluminium alloy are present such that Si/Mg weight ratio is more than 4.5.

23. The method according to claim 1, wherein the Si- and Mg-content in the Al—Si—Mg aluminium alloy are present such that Si/Mg weight ratio is more than 5.0.

24. The method according to claim 1, wherein the Cu-content in the Al—Si—Mg aluminium alloy is up to 0.10%.

25. The method according to claim 1, wherein the Cr-content in the Al—Si—Mg aluminium alloy is up to 0.03%.

* * * * *